United States Patent [19]

Pires

[11] 4,138,809

[45] Feb. 13, 1979

[54] HAIR TRIMMER

[75] Inventor: Antonio Pires, Wallingford, Conn.

[73] Assignee: Sperry Rand Corporation, Bridgeport, Conn.

[21] Appl. No.: 825,335

[22] Filed: Aug. 17, 1977

[51] Int. Cl.[2] ..... B26B 19/20

[52] U.S. Cl. ..... 30/200

[58] Field of Search ..... 30/200, 201

[56] References Cited

U.S. PATENT DOCUMENTS

| | | | |
|---|---|---|---|
| 481,977 | 9/1892 | Smith | 30/201 |
| 2,941,293 | 6/1960 | Mazzoni | 30/201 |
| 3,046,654 | 7/1962 | Letchfield | 30/201 |
| 3,842,498 | 10/1974 | Mizobata | 30/216 X |

*Primary Examiner*—Jimmy C. Peters

*Attorney, Agent, or Firm*—Charles R. Miranda; Joseph S. Failla

[57] ABSTRACT

An improved hand-held electric powered hair trimming appliance is described comprising a comb and a cutter. The appliance is adapted to be advanced along a bed of hair in the same type of combing motion as is used to style the hair and the cutter is transported simultaneously with the comb. The comb is adapted to apply a force to strands of hair being combed causing distal segments thereof to deflect away from the bed of hair. The cutter is positioned in the path of the deflected segments of hair for shearing thereof by the cutter. Predetermined spacing of the cutter with respect to the comb provides for the majority of the sheared distal segments having a predetermined length.

7 Claims, 20 Drawing Figures

74
75
73
60
124
64
104
164
142
148
120
52
95
90
150
136
10
175
174
165
176
146
163
166
144
93
167
173
171
158
168

Fig. 18.
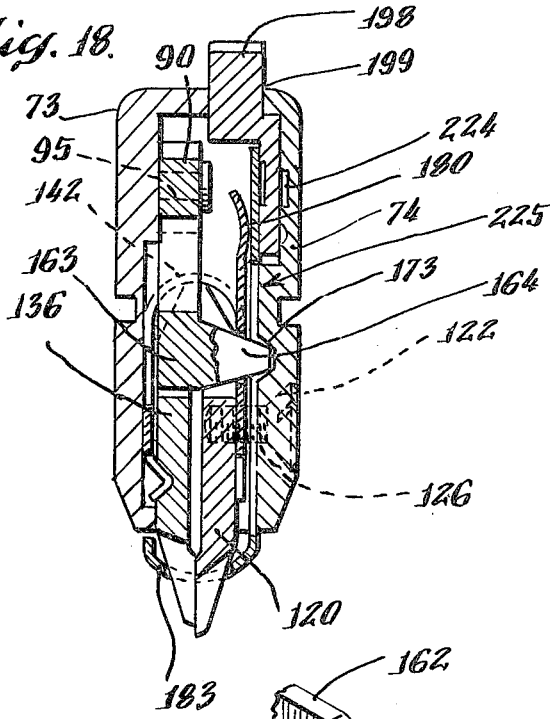
Fig. 19.
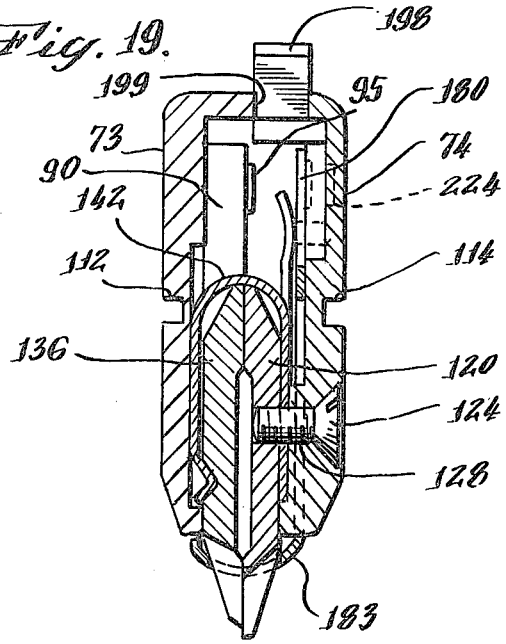
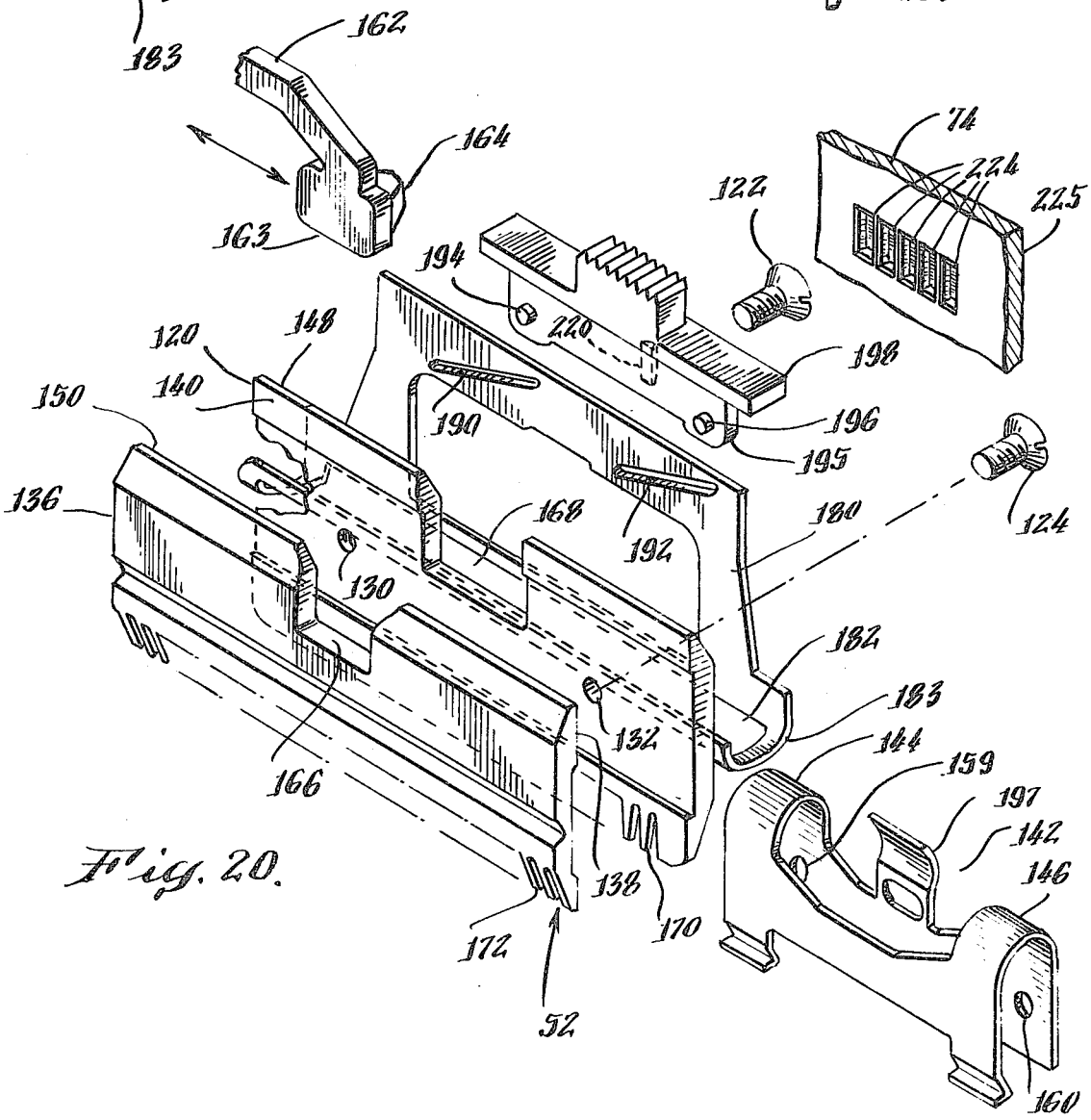
Fig. 20.

HAIR TRIMMER

BACKGROUND OF THE INVENTION

This invention relates to hair trimming appliances. The invention relates more particularly to an improved, electrically energized hair trimmer which permits an individual to trim his own hair or an untrained person to trim another person's hair without gouging, overcutting or causing damage to a hair style.

Maintenance of personal hair styles between style changes is generally provided by trimming and thinning of the hair. It is desirable both from a convenience and from an economic viewpoint to provide an electrically energized trimmer device for hair style maintenance which can be used by individuals to trim their own hair or alternatively which can be operated in trimming of another person's hair by a person without professional training. Principal limitations in trimming one's own hair or having it trimmed by a person without professional training are inexperience in handling powered hair trimmers and, in the case of timming one's own hair, the limited view which a person can have of his head while trimming. These considerations introduce a potential for gouging or overcutting a hair style which can result in damage to the hair style. This is particularly true with powered trimmers such as electrically energized trimmers which can rapidly cause extensive damage before such damage is realized.

Known hair trimming appliances have taken several forms. In one arrangement, a powered hair cutter means is provided and the problem of gouging and overcutting is simply left to the developing skill of a user in handling the trimmer. Another form of hair trimmer device is known in which it is attempted to avoid this problem by providing a means for maintaining the cutter at a predetermined distance from an individual's head during trimming thereby leaving a substantially uniform length of hair on a person's head. However, this form of trimmer is not useful with present day hair styles since trimming the hair to a uniform length would in most cases destroy the hair style. Other trimmer arrangements have been provided which include means for limiting the amount of hair accessible to the trimmer blades. While this latter arrangement limits overcutting to some extent, it is ineffective in limiting gouging, and it requires the acquisition of a moderate degree of skill in its use.

What is desirable and what I have provided in accordance with features of my invention is a powered hair trimming device which an individual can draw through his hair in the same type of simple combing motion as is used in styling the hair while having the assurance that the trimmer will shear only distal segments of the hair having substantially a predetermined length.

Accordingly, it is an object of this invention to provide an improved electrically powered hair trimmer for use by an individual for self-trimming of his hair or by a person without professional training for trimming another person's hair and which is adapted to eliminate overcutting or gouging of a hair style.

Another object of the invention is to provide a hair trimmer which shears distal hair segments, the majority of such segments having a substantially uniform length.

Another object of the invention is to provide a hair trimmer having adjustable means for cutting segments of hair of selectable, substantially uniform lengths.

SUMMARY OF THE INVENTION

My invention takes advantage of a characteristic of hair. An application of a force F to a strand of hair located in or on a bed of hair, such as is found within an individual's hair style, in a direction generally normal to the length of the hair strand will result in a deflection of a tip of the hair strand away from the bed of hair. More particularly, within a range of locations along the hair strand, the application of a force to the hair strand at locations progressively closer to the tip of a strand of hair causes progressively larger deflection of the tip of the hair strand away from the bed.

An improved hair trimmer in accordance with features of the present invention comprises a force applying means which is adapted to be advanced along a bed of hair in a simple combing motion and which establishes a force on hair strands of the bed of hair and causes the strands to deflect away from the bed. A cutter means is transported simultaneously therewith and is positioned in the path of deflecting hair strands for shearing distal segments of hair strands which are deflected into its path. The cutter means has a row of cutter teeth which is spaced with relation to a point of force application for providing that the majority of hair strands which are deflected into the cutter teeth are sheared into segments which have a predetermined, substantially same length. A means is provided for advancing the force applying means and the cutter means in the desired relationship and an electrically energized means is provided for actuating the cutter means.

In accordance with more particular features of the invention, the force applying means comprises a comb body having a plurality of spaced apart teeth which extend from the comb body and a surface formed in the comb body between the comb teeth for establishing a force on hair strands causing them to deflect between the comb teeth, away from the bed of hair, and into the path of the cutter teeth.

In accordance with another feature of the invention, an adjustable means is provided for controlling contact between a deflected hair strand and the cutter means. In a particular embodiment, an adjustable means is provided for selectively positioning the comb body with respect to the cutter means for controlling contact. In another embodiment the adjustable means comprises a barrier positioned around the cutter teeth and means for selectively positioning the barrier so as to expose differing depths of the cutter teeth to the deflected hair strands.

BRIEF DESCRIPTION OF THE DRAWINGS

These and other objects and features of the invention will become apparent with reference to the following specification and the drawings wherein:

FIG. 18 is a fragmentary sectional view taken along lines 18—18 of FIG. 16;

FIG. 19 is a fragmentary sectional view taken along lines 19—19 of FIG. 16; and

FIG. 20 is an enlarged, exploded view of the cutterhead assembly of FIG. 16.

DETAILED DESCRIPTION OF THE INVENTION

Figure 1:
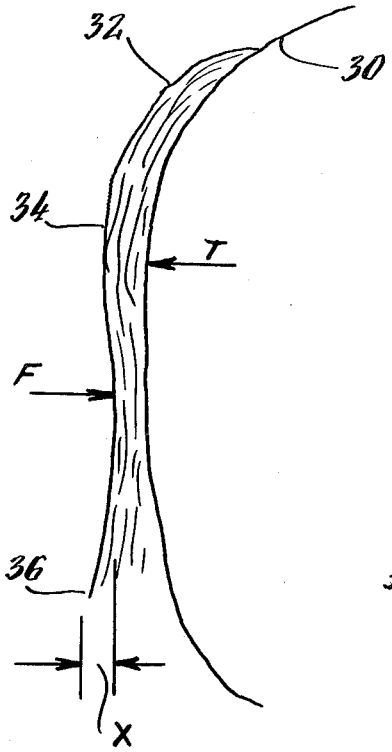
FIG. 1 is a fragmentary view of a portion of a person's head having a bed of hair and illustrating the application of a force to a strand of hair at a first location on the hair strand.
Figure 2:
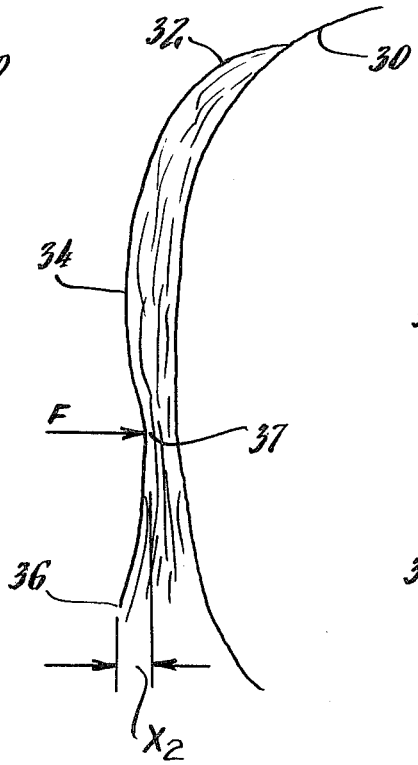
FIG. 2 is a view of the person's head and hair bed of FIG. 1 and illustrating the application of the force at a second location along the hair strand.
Figure 3:
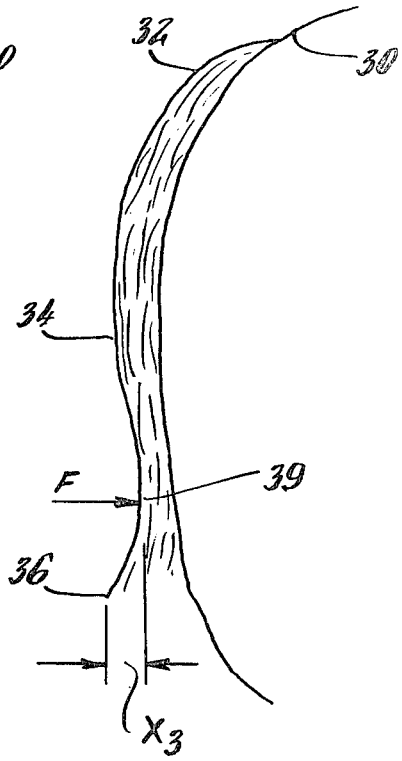
FIG. 3 is a view of the person's head and hair bed of FIG. 1 and illustrating the application of a force at still another location along the length of a hair strand.

The features of the present invention may best be understood by reference to FIGS. 1-3 which illustrate the outline of a person's head 30. A large number of strands of human hair extend from head 30 to form a bed of hair, referred to generally by reference number 32, and are arranged in a hair style or hairdo. It will be noted that in bed 32 many hair strands overlay other hair strands to form a cushion of hair having a thickness T which is shown to be the distance from head 30 to outer hair strands of bed 32. Bed 32 operates as a resilient cushion and when a force is applied by a finger for example to the bed, it will compress at the location of the force. Because of its resilient characteristic bed 32 will relax upon removal of the force and will substantially assume its undeformed thickness.

The application of a force F to hair strands laying on or within the thickness of the bed such as hair strand 34 having a distal tip 36 causes a reaction throughout hair strand 34 resulting in a deflection of tip 36 having a displacement from bed 32. As force F is applied at locations progressively closer to tip 36, displacement X will, up to a point, increase progressively in magnitude. This is illustrated in FIG. 2 where force F is exerted at a location 37 closer to tip 36 than in FIG. 1 and results in an increased displacement, $X_2$, of tip 36 while in FIG. 3, force F is shown applied at a location 39 closer to tip 36 resulting in an even larger displacement $X_3$, of tip 36. This reaction and displacement of tip 36 is attributable to natural characteristics of hair and to the fact that hair strand 34 is cushioned by the resiliency of bed 32. A hair bed having a thickness T on the order of about ¼ inch is desirable for this characteristic reaction. While the displacement X of tip 36 will increase in magnitude to a maximum as the location at which a given force is applied approaches tip 36, the amount of deflection will decrease as the given force approaches a location adjacent tip 36 of hair strand 34. The specific reaction of a strand of hair to the application of a force as indicated also varies between individuals depending upon the consistency and oil content of the hair. The reaction is also known to vary for an individual between hair rinses, since the oil content appears to increase between hair rinses. The greatest uniformity between individuals is found immediately after a hair rinse.

Figure 4:
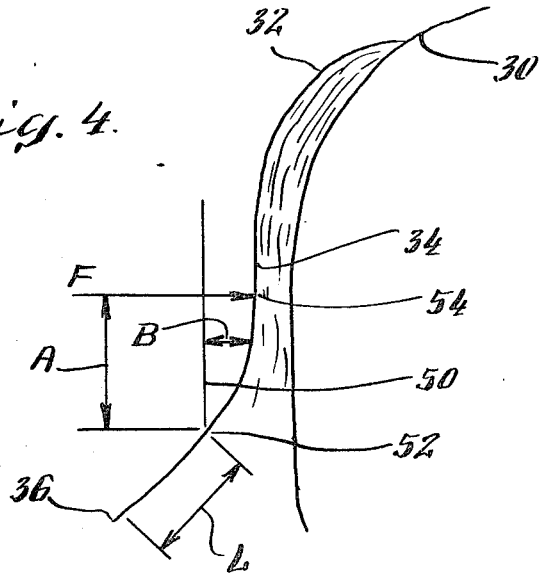
FIG. 4 is a schematic diagram illustrating the application of a force to a hair strand and the positioning of a cutter blade with relation to a point of application of the force.

The present invention takes advantage of the above described characteristic. A cutter means shown schematically in FIG. 4 and represented generally by reference numeral 50 provided with an elongated row of cutter teeth 52. A means is provided for establishing a force on hair strand 34 at a location 54. The row of cutter teeth 52 is positioned with respect to location 54 so as to lie in a deflection path of that portion of hair strand 34 extending between location 54 and distal tip 36 of hair strand 34. By positioning cutter teeth 52 with respect to location 54 and simultaneously transporting the force establishing means and cutter means 50, hair strands are deflected toward cutter teeth 52 and a segment L of hair strand 34 of predetermined length as determined by spacing coordinate distances A and B will be sheared by cutter teeth 52. A desired maximum length of segment L is established by adjusting coordinates A and B.

Force F is established on bed 32 by a comb means (FIG. 5), more fully described hereinbelow and referred to generally as 60, which includes a plurality of spaced apart comb teeth 62 and a force applying surface 64 (FIG. 7) located between comb teeth 62 at which force F is applied to bed 32. Comb teeth 62 stroke through the bed 32 causing hair strands to flow between comb teeth 62 and beneath the force applying surface 64 at which location a force generally normal to a strand is applied thereby. By adjusting coordinate spacings A and B (FIG. 4) between cutter teeth 52 and force applying surface 64, a predetermined length of segment L of hair strand 34 will be sheared.

Figure 5:
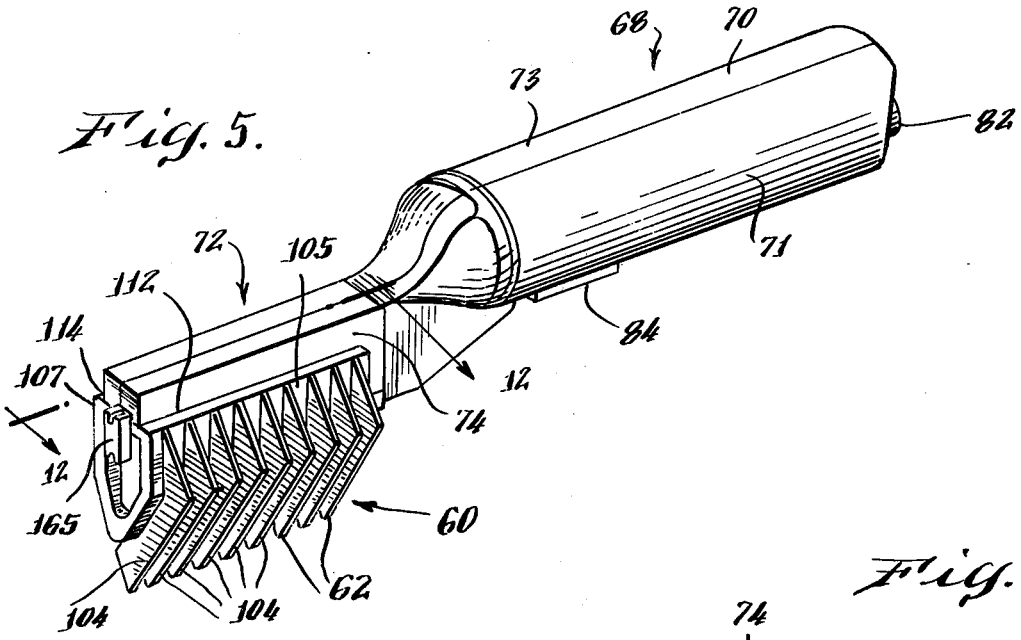
FIG. 5 is a perspective view of an embodiment of a hair trimmer constructed in accordance with features of this invention.
Figure 6:
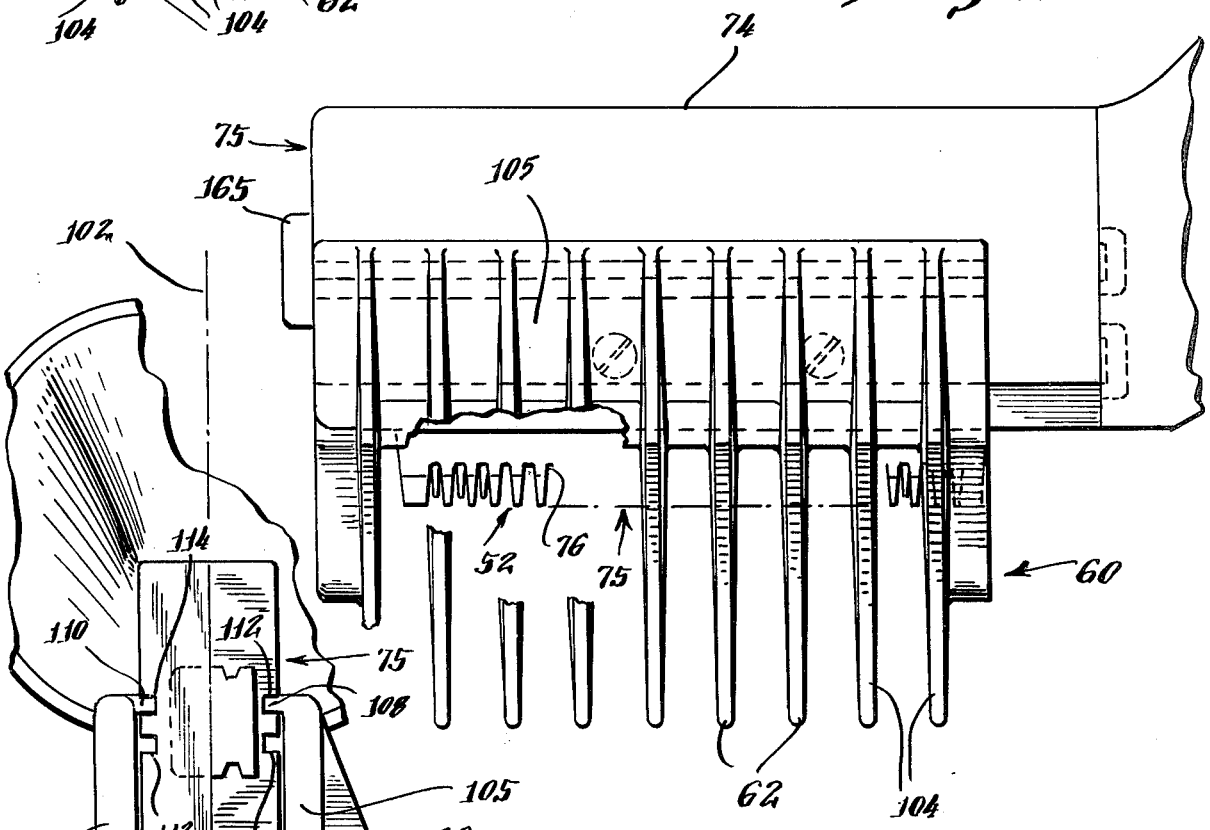
FIG. 6 is an enlarged, fragmentary, side elevation view of a cutterhead and comb assembly of the hair trimmer of FIG. 5.

FIG. 5 illustrates an embodiment of the invention wherein a means is provided for supporting and transporting comb means 60 and the row of cutter teeth 52 in a desired relationship. This means comprises an elongated appliance housing 68 including a generally cylindrical shaped handle 70 having a central axis and an offset end 72 for supporting cutter means 50 and comb means 60 for transport therewith. Handle 70 is handheld and the appliance is advanced along the hair bed in a combing motion. Offset end 72 supports the row of cutter teeth 52 displaced from the central axis of handle 70 so as to provide enhanced visibility of cutter teeth 52 during the combing motion of the appliance.

A preferred embodiment of the present invention is illustrated in greater detail in FIGS. 5-14. Housing 68 is split longitudinally and in FIG. 5, is shown to comprise a base 73 and a housing cover 71 to form handle 70. Base 73 extends from handle 70 to form with a cover 74 on clipper assembly 75 offset end 72. An electric motor 80 (FIG. 12), having an output drive shaft 88 is mounted within handle 70 and electrical energy is applied to motor 80 from a line cord 82 which extends into handle 70. A switch actuator 84 is provided which is operable by finger force to complete an electric circuit, not illustrated, for electrically energizing motor 80. A rotary to reciprocating motion converter 86 is positioned in handle 70 to convert rotary motion of drive shaft 88 to reciprocating motion of a drive member 90.

Cutter means 50 (FIG. 4) comprises a clipper assembly 75 (FIG. 6) which includes the aforementioned clipper cover 74 and a clipper cutter assembly 76, as more fully described hereinafter. Cutter assembly 76 includes a stationary cutter 120 (FIG. 11) and a movable cutter 136. Movable cutter 136 is positioned for sliding engagement with stationary cutter 120 defining therebetween a cutting plane 102 (FIG. 7) extending through cutter assembly 76 and the row of cutter teeth 52. Drive member 90 extends from handle 70 into offset end 72 and is coupled to movable cutter 136 for imparting reciprocating motion thereto.

Figure 7:
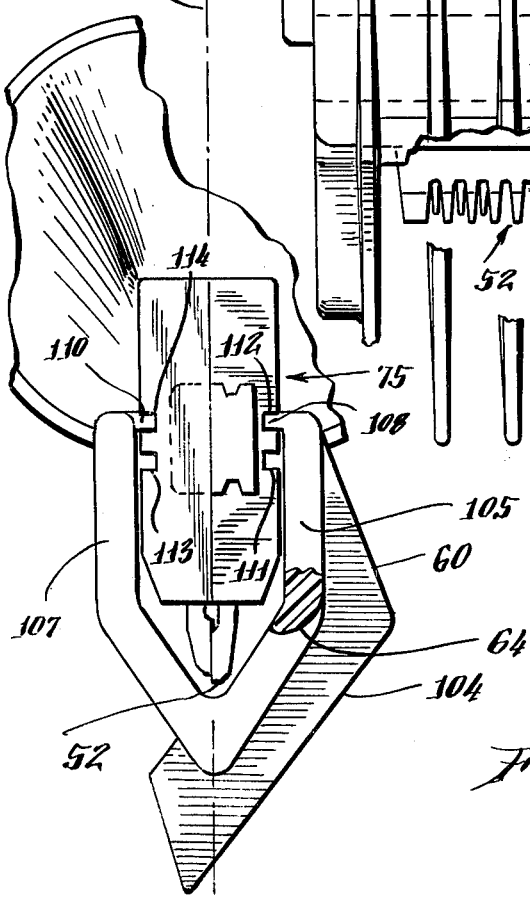
FIG. 7 is a fragmentary front elevation view of the hair trimmer of FIG. 5.
Figure 12:
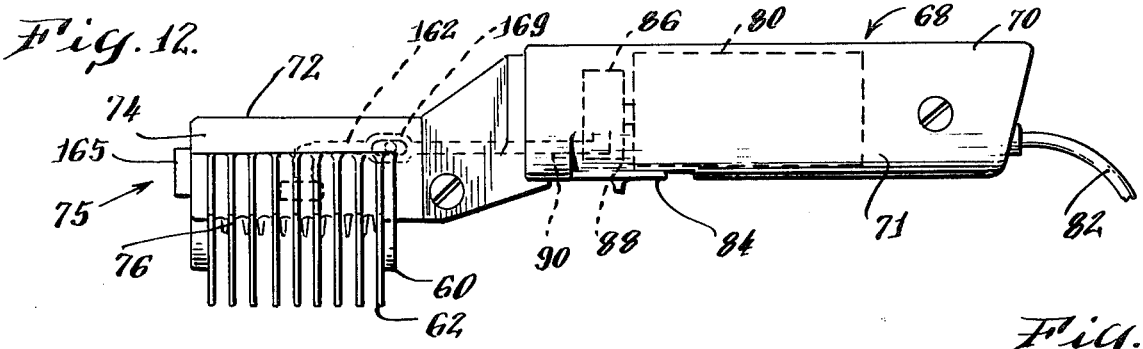
FIG. 12 is a side elevation view of the hair trimmer of FIG. 5.
Figure 13:
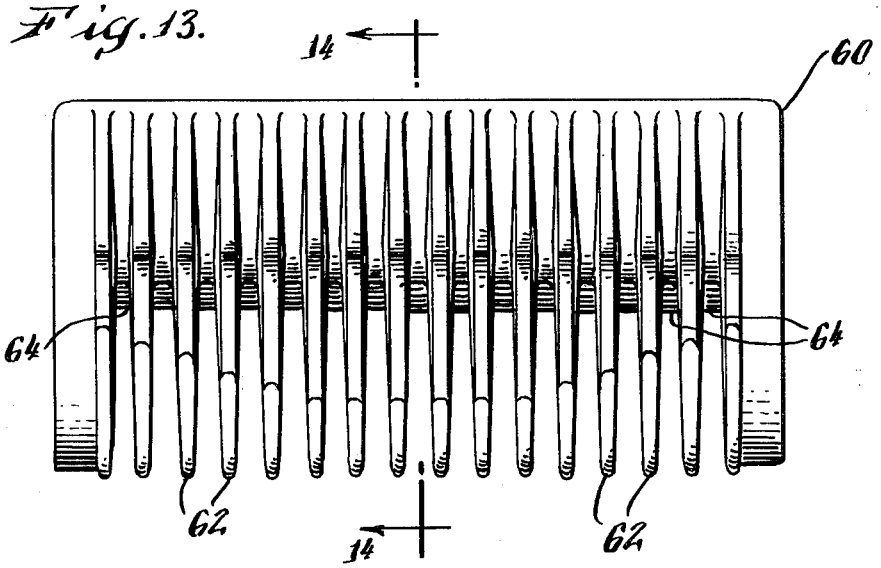
FIG. 13 is an enlarged side elevation view of a comb utilized with the trimmer of FIG. 5.
Figure 14:
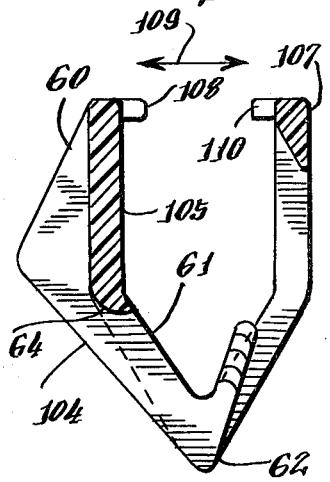
FIG. 14 is a sectional view taken along lines 14—14 of FIG. 13.

Comb means 60 as shown in FIGS. 5, 6, 7, 9, 12, 13 and 14 comprises a comb body 61 having a plurality integrally formed comb teeth 62. Upon mounting of comb means 60, comb teeth 62 are orientated in a tapering attitude with respect to cutting plane 102 (FIG. 7). Each of comb teeth 62 include a relatively linear and flat rib 104 for supporting and guiding the trimmer as the trimmer is advanced by hand motion along bed 32. Comb body 61 (FIG. 14) is arranged in a generally U-shaped configuration and extends substantially coextensively with offset end 72 (FIG. 12). Comb body 61 includes an elongated wall 105 from which comb teeth 62 extend. The portion of wall 105 extending between comb teeth 62 forms force applying surface 64. An elongated frame 107 is disposed on comb body 61 opposite wall 105. Comb teeth 62 and body 61 are formed integrally of a polymer plastic, for example. Frame 107 is resiliently deflectable as indicated by arrow 109 (FIG. 14) for enabling positioning of comb body 61 about offset end 72. Inwardly facing spaced tabs 108 and 110 which are integrally formed in wall 105 and frame 107 respectively extend laterally therefrom in opposed relationship. Tabs 108 and 110 engage elongated grooves 112 and 114 formed on opposite longitudinal surfaces of offset end 72 and provide for demountably securing comb means 60 in position on offset end 72. Comb means 60 may be positioned on offset end 72 for left or right hand use. Alternatively, comb means 60 may be demountably secured to lower grooves 111 and 113 formed in the offset end 72. The position of comb means 60 with respect to cutter means 50 is thereby selectively adjustable.

Figure 11:
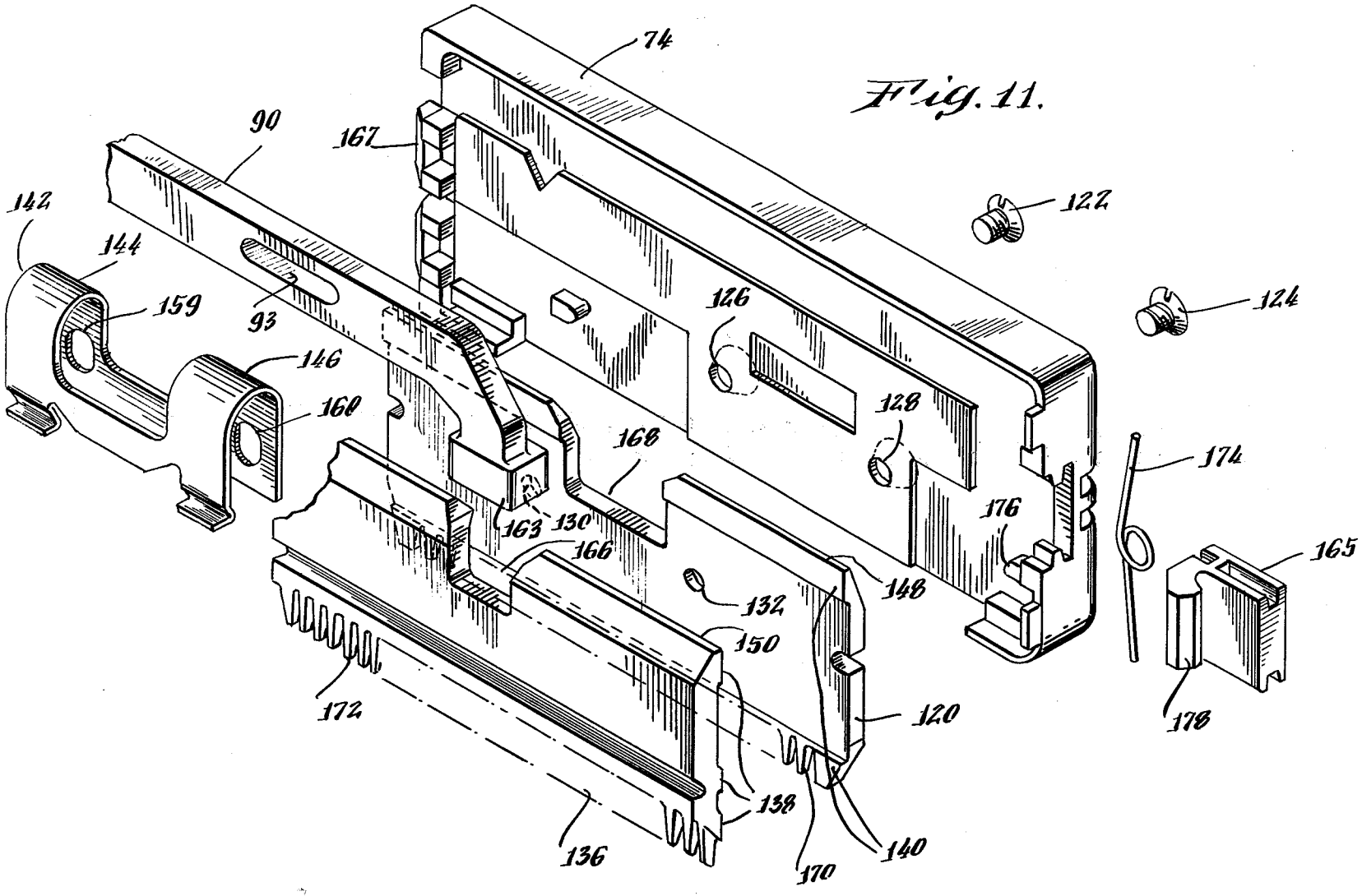
FIG. 11 is an enlarged exploded view of the cutterhead assembly of FIG. 8.

Cutter assembly 76 which is best seen in FIGS. 8–11 is shown to comprise the aforementioned stationary cutter 120 which is mounted to clipper cover 74 by screws 122 and 124. These screws extend through apertures 126 and 128 formed in cover 74 and engage threaded apertures 130 and 132 of stationary cutter 120. The aforementioned movable cutter 136 includes a surface 138 which is positioned in sliding contact with a surface 140 of stationary cutter 120. The cutters are maintained in vertical alignment and sliding engagement by an elongated U-shaped resilient spring clip 142 having bight portions 144 and 146 which extend around upper edge surfaces 148 and 150 respectively of cutters 120 and 136. Mounting screws 122 and 124 extend through elongated apertures 159 and 160 respectively formed in a wall segment of spring clip 142 and secure spring clip 142 to stationary cutter 120. Apertures 159 and 160 are elongated in a vertical direction as illustrated in FIG. 11 in order to provide for the vertical alignment of movable cutter 136 relative to stationary cutter 120.

Figures 8, 9, 10:
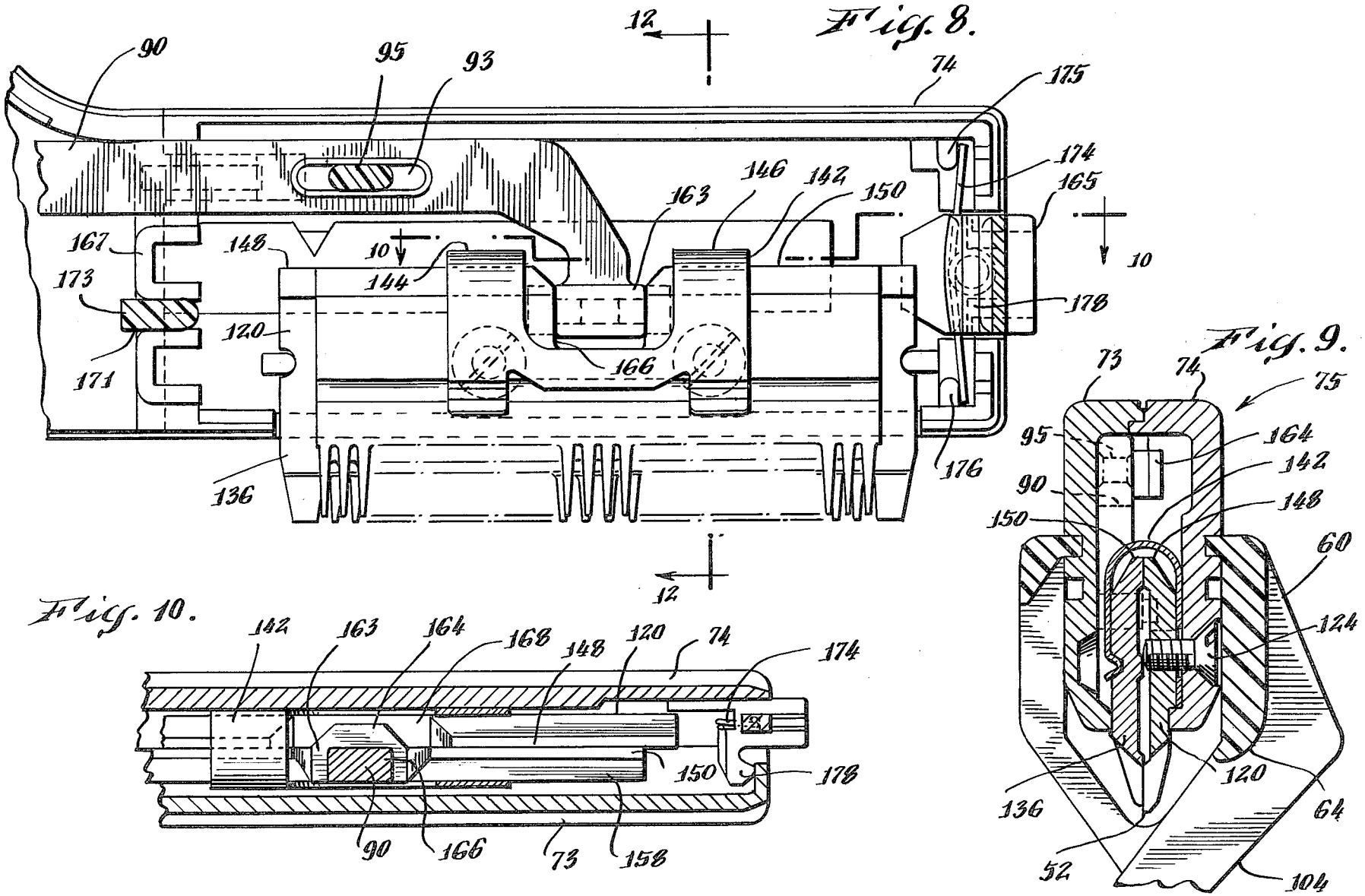
FIG. 8 is an enlarged, fragmentary, cut-away side elevation view of a cutterhead assembly of the hair trimmer of FIG. 5.
FIG. 9 is a view taken along line 12—12 of FIG. 8.
FIG. 10 is a view taken along line 10—10 of FIG. 8.

As previously mentioned, reciprocating motion is imparted to movable cutter 136 by drive member 90 (FIG. 8). Drive member 90 is restricted to rectilinear motion by a guide pin 95 formed on base 73 which projects into an elongated slot 93 formed in drive member 90. Lateral motion of drive member 90 is restricted by a guide 97 extending from housing cover 71 into offset end 72 and is positioned to overlay drive member 90. One end of drive member 90 includes a generally rectangular shaped depending portion 163 from which a taper shaped projection 164 (FIG. 10) extends in a lateral direction. Depending portion 163 is positioned in a notch 166 which is formed centrally within movable cutter 136. A similar notch 168 is formed in stationary cutter 120 to provide clearance for projection 164 which extends partly into notch 168. Stationary cutter 120 and movable cutter 136 are provided with cutter teeth 170 and 172 which together form the array of cutter teeth 52 which upon reciprocating motion of movable cutter 136 operate to shear any hair strands which extend between these teeth along the array of cutter teeth 52 as described hereinbefore.

Figure 15:
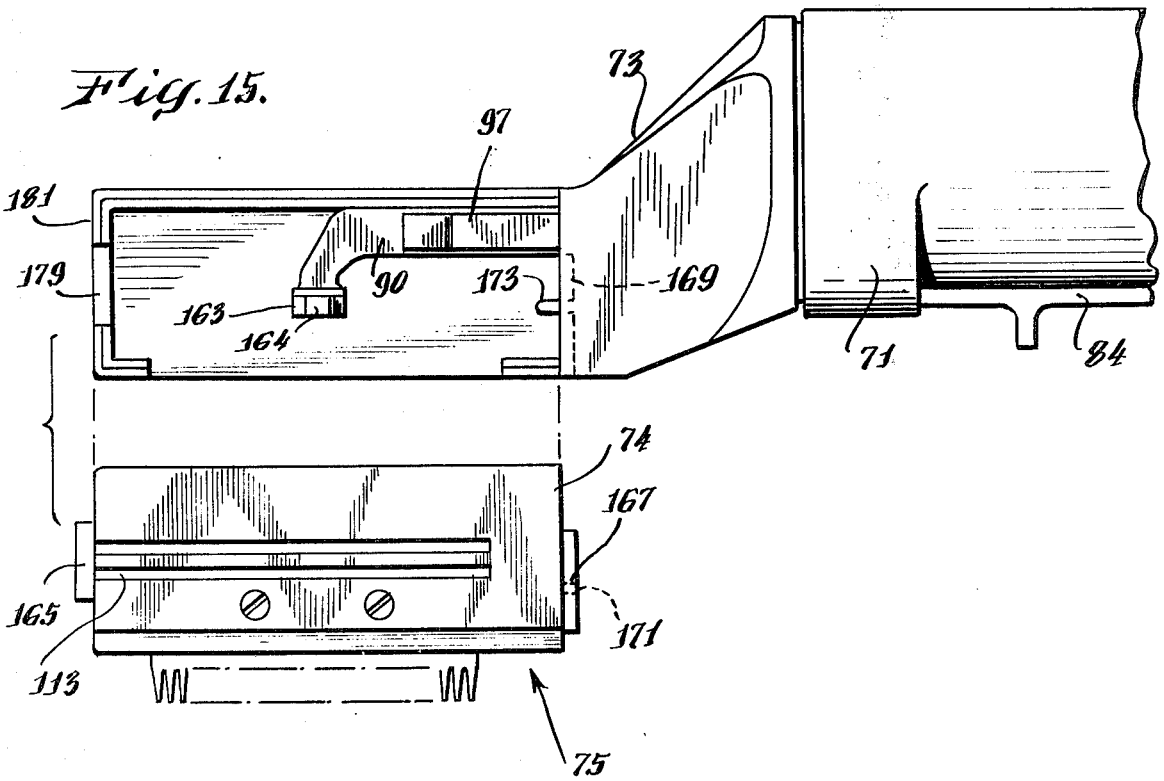
FIG. 15 is a fragmentary side view of the hair trimmer of this invention illustrating a clipper assembly demounted from the trimmer.
Figure 16:
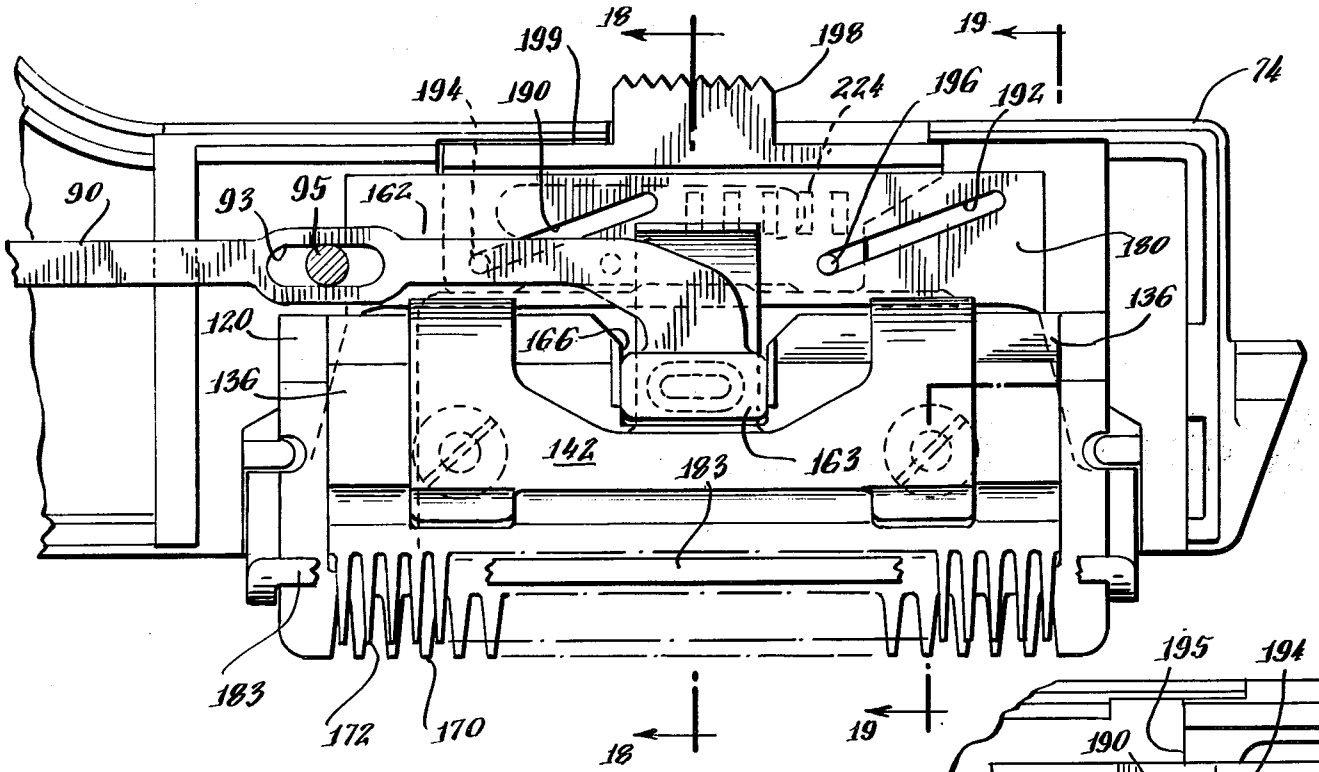
FIG. 16 is an enlarged fragmentary view of an alternative clipper cutter illustrating the positioning of an adjustable cutter barrier in a first selectable position.

Clipper assembly 75 is adapted to be captivated and secured to housing 68. Clipper cover 74 is fabricated of plastic, for example, and as previously mentioned is shaped to form, with the offset portion of base 73, offset end 72 (FIG. 5). Offset end 72 provides a housing for drive member 90, cutter assembly 76 and a support for comb means 60. As illustrated in FIG. 8, clipper assembly 75 includes a hand-actuatable latch 165 positioned at a forward end of clipper assembly 75 and an integrally formed tab 167 (FIG. 15) formed at an opposite end of clipper cover 74. A recess 169 is formed in a portion of housing cover 71 and tab 167 is configured and positioned to engage recess 169. A slot 171 formed in tab 167 engages a rib 173 which is integrally formed with base 73 (FIG. 15) to establish orientation of clipper assembly 75 with respect to cover 71 and base 73. Latch 165 is biased in a forward direction by a spring strip 174 (FIG. 8). Spring strip 174 is captivated between bosses 175 and 176 which are integrally formed with clipper cover 74. As illustrated in FIG. 10, latch 165 includes an extending hook 178 which engages a tab 179 (FIG. 15) at a distal end 181 of base 73. Clipper assembly 75 is positioned on housing 68 by introducing tab 167 into recess 169 of cover 71. As tab 167 is introduced into this recess, hook 178 is deflected sufficiently to engage tab 179 and maintain clipper assembly 75 captivated on housing 68. Clipper assembly 75 is demounted by depressing latch 165 and withdrawing tab 167 from recess 169.

In operation, the hair trimming appliance as illustrated and described is energized by operation of switch actuator 84. Ribs 104 of comb teeth 62 are drawn along the bed of hair strands to be trimmed. Hair strands will be deflected, as described hereinbefore, into the path of the array of cutter teeth for shearing segments of predetermined length from the hair strands. The majority of sheared segments will be of substantially the same length. In practice, I have found that on the order of 62% of the strands will be of substantially the same desired length, approximately 28% of the strands will be slightly larger than the desired length while about 10% of the strands will be somewhat greater in length. For example, for establishing a cut segment length of $\frac{7}{8}$ of an inch coordinate distances A and B (FIG. 4) of $\frac{1}{4}$ inch and 5/32 inch respectively, are provided between force applying surfaces 64 and the array of cutter teeth 52. I have found that about 62% of the segments will be $\frac{7}{8}$ of an inch in length or less, 28% will be in the range of 1 inch to $1\frac{1}{8}$ inch and 10% will be in the range of $1\frac{1}{4}$ inch and greater. These variations in length are attributable to such factors as the oil content of hair, the type of hair styling and other personal factors.

An alternative arrangement for selectively adjusting contact between a deflected hair strand and the cutter means is illustrated in FIGS. 16–20. Those elements of the trimmer of FIGS. 16–20 which perform the same function as elements described hereinbefore bear the same reference numerals.

Figure 17:
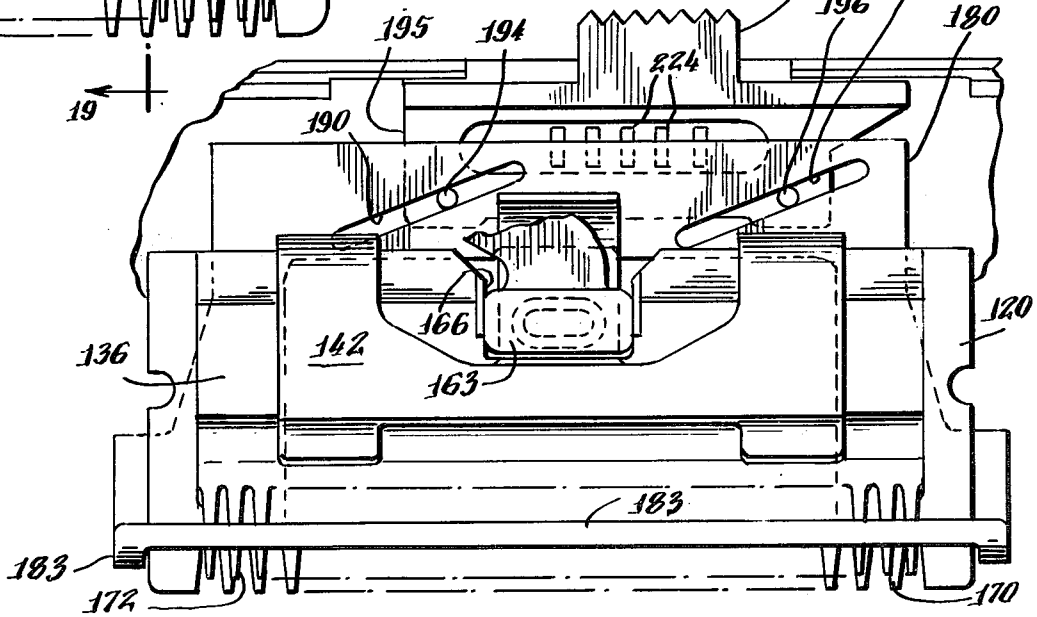
FIG. 17 is an enlarged fragmentary view of the cutter arrangement of FIG. 16 and illustrating the cutter barrier in a second adjustable position.

An adjustable barrier means is provided in clipper assembly 75 and includes a plate 180 (FIG. 20) having a slot or window 182 formed in a flange 183 of plate 180. Plate 180 is positioned for providing that the array of cutter teeth 52 extend through window 182 and outwardly of housing 68. The barrier means includes means for adjusting the length of exposure of cutter teeth 52 through window 182. A pair of spaced slots 190 and 192 are formed in an upper portion of plate 180. Slots 190 and 192 are orientated at an angle with respect to flange 183 and receive bosses 194 and 196 extending from one side of a wall 195 on a slide member 198. Leg member 147 of spring clip 142 is provided with a resilient tab 197 which bears against plate 180 between slots 190 and 192 to urge plate 180 against slide 198 to maintain slots 190 and 192 in engagement with bosses 194 and 196 respectively. Slide member 198 extends through an elongated opening 199 (FIG. 19) formed in clipper cover 74 and is adapted for longitudinal motion in opening 199. As slide member 198 is moved in a longitudinal direction, the movement of bosses 194 and 196 in slots 190 and 192 cause vertical motion of plate 180. By moving slide 198 rearward and toward left as viewed in FIG. 16, plate 180 is transported in a vertical direction to position flange 183 for the maximum length of exposure of cutter teeth 52. Flange 183 of plate 180 limits the amount of deflection of hair strands into cutter teeth 52 and the segment of sheared hair is at its longest length. On the other hand, advancing slide 198 toward the right as shown in FIG. 17 lowers flange 183 to a desired position for decreasing the length of the cut segment. Flange 183 is adapted for incremental vertical positioning relative to cutter teeth 52 by detenting means. Detenting of slide member 198 and therefore plate 180 and the position of flange 183 is provided by a boss 220 (FIG. 20) which is formed on the other side of wall 195 of slide member 198 and by a plurality of horizontally spaced grooves 224 formed in an inner surface 225 of clipper cover 74. Boss 220 and grooves 224 are formed with complementary camming surfaces which cause slide 198 and plate 180 to move laterally and deflect tab 197 of spring clip 142 as boss 220 is moved across the horizontally spaced grooves 224. The spring force of tab 197 provides for detenting of boss 220 into a selected groove 224 to hold flange 183 at a preselected relationship with respect to cutter teeth 52. The adjustable barrier means described provides for controlling the segment length of the sheared hair without altering the position of cutter teeth 52 or comb means 60 with flange 183 positioned at a preselected maximum vertical distance from the tip of the array of cutter teeth 52, a maximum segment length of cut hair can be established by preselecting the spacing between the force applying surface 64 of comb means 60 with respect to the cutter teeth 52. This maximum segment length of cut hair can be selectively decreased with the adjustable barrier means by moving flange 183 incrementally in a vertical direction from a maximum position to a position closer to the tip of the array of cutter teeth. The positioning of flange 183 closer to the tip of the array of cutter teeth also advantageously reduces the quantity of hair which can be cut in a single stroke of the trimmer through a bed of hair strands.

An improved trimmer device has thus been described which advantageously provides for the trimming of hair styles by an individual or by an untrained person using a cimple combing motion without concern over gouging, overcutting or destroying a hair style. This is accomplished by limiting the length of hair which is cut from the hair style. In addition, an adjustable means is provided for varying the length of hair cut from the hair style from a predetermined maximum size to relatively shorter selectable sizes.

While I have described particular embodiments of my invention, it will be appreciated by those skilled in the art that variations may be made thereto without departing from the spirit of the invention and the scope of the appended claims.

What is claimed is:

1. An improved hair trimmer comprising:

a. a housing;

b. a cutter assembly supported by said housing and including an elongated row of cutter teeth, extending from said housing;

c. an elongated comb body positioned on said housing laterally spaced from said row of cutter teeth and longitudinally aligned therewith;

d. a plurality of spaced apart rectilinear rib-like comb teeth depending from said comb body slanted in a direction transverse of said row of cutter teeth, said comb teeth adapted to form a bed of hair in the spaces between the comb teeth when the trimmer is advanced along hair to be trimmed;

e. a surface formed on said comb body for applying a force to hair strands of said bed of hair, said force applying surface spanning the space between adjacent comb teeth and adapted to apply a force to said hair strands upon said advance of the trimmer causing deflection of distal segments of the hair strands in a path of travel away from said bed of hair in a direction towards and transversely of said row of cutter teeth, and f. said row of cutter teeth being spaced relative to said force applying surface in the path of travel of said distal segments for engaging and shearing said distal segments, said relative spacing providing that a majority of sheared distal segments have substantially the same length.

2. The improved hair trimmer of claim 1 wherein said rib-like comb teeth are provided with first linear surfaces adjacent said row of cutter teeth and second linear surfaces spaced from said first linear surfaces for supporting and guiding the trimmer as it is advanced along hair to be trimmed, and said second linear surfaces being spaced from said force applying surface for providing a thickness to said bed of hair.

3. The improved hair trimmer of claim 2 wherein said spacing of the second linear surfaces from said force applying surface provides said bed of hair with a thickness of approximately one-quarter inch.

4. The trimmer of claim 2 wherein said housing includes a handle and an offset end extending from said handle said cutter assembly and said comb body supported on said offset end for transport therewith with said force applying surface positioned in said relative spacing with said row of cutter teeth.

5. The trimmer of claim 4 wherein said offset end including spaced elongated grooves formed on opposite surfaces thereof and said comb body being formed in a U-shaped configuration spanning said offset end and having opposed pairs of longitudinally spaced and aligned tabs formed thereon which provide for selectively demountably securing said comb body in a selected position on said offset end.

6. The improved hair trimmer of claim 1 including means for selectively adjusting the amount of deflection of said distal segments of hair strands away from the bed of hair into said row of cutter teeth by varying said relative spacing of said force applying surface and said row of cutter teeth.

7. The hair trimmer of claim 6 wherein said adjusting means comprises a plurality of parallel grooves formed on opposed surfaces of said housing, and an opposed pair of longitudinally spaced and aligned tabs positioned on said comb body for engaging said grooves.

* * * * *